US010124606B2

(12) United States Patent
Butt et al.

(10) Patent No.: US 10,124,606 B2
(45) Date of Patent: Nov. 13, 2018

(54) UNDER-GLASS DIGITAL PRINTING METHOD OF MULTILAYER SYNTHETIC LEATHER

(71) Applicants: Nouman Idris Butt, Sialkot (PK); Michiko Yoshida Mariam Siddiqa, Sialkot (PK)

(72) Inventors: Nouman Idris Butt, Sialkot (PK); Riaz Ud-Din Sheikh, Sialkot (PK); Michiko Yoshida Mariam Siddiqa, Sialkot (PK)

( * ) Notice: Subject to any disclaimer, the term of this patent is extended or adjusted under 35 U.S.C. 154(b) by 0 days.

(21) Appl. No.: 15/214,691

(22) Filed: Jul. 20, 2016

(65) Prior Publication Data

US 2017/0320336 A1 Nov. 9, 2017

(30) Foreign Application Priority Data

Apr. 20, 2016 (PK) ..... 226/2016
May 26, 2016 (PK) ..... 296/2016

(51) Int. Cl.
*B41J 3/407* (2006.01)
*A63B 45/02* (2006.01)
*B41J 11/00* (2006.01)

(52) U.S. Cl.
CPC ..... *B41J 3/4078* (2013.01); *A63B 45/02* (2013.01); *B41J 11/0015* (2013.01)

(58) Field of Classification Search
CPC ..... B41J 3/4078
See application file for complete search history.

(56) References Cited

U.S. PATENT DOCUMENTS 5,741,195 A * 4/1998 Sullivan ..... A63B 43/06 473/570
6,039,662 A * 3/2000 Chan ..... A63B 41/08 473/599

(Continued)

FOREIGN PATENT DOCUMENTS

GB 2540011 A * 1/2017 ..... D06P 5/002
JP 2003033448 A * 2/2003

(Continued)

OTHER PUBLICATIONS

Machine generated English translation of JP 2003-033448A to Shishido et al., "Leather Panel for Ball Game and Production Method of the Same"; retrieved via escpacenet.com on Aug. 29, 2017; 14pp.*

*Primary Examiner* — Shelby Fidler

(57) ABSTRACT

This invention is about a digital printing method of cover sheet of a flexible material of required features of density, flexibility and thickness. This method includes steps of printing a cover sheet of woven or non-woven fabric, by using digital or computerized printing techniques, either direct printing or by transfer paper printing or sublimation printing technique. The printed side of the cover sheet is laminated or coated with a clear film of flexible transparent material like polyurethane, thermoplastic polyurethane, polyethylene or polyvinylchloride. This laminated or sealed printed and coated cover sheet may be fixed to different fabric, foam or of outer surface layer of an article at which printing is required. The said article may be sport's good, sport's wears, dresses, footwear, furniture covering sheets and vehicle items covers etc. The novel method of making cover sheet enables customized printing at required articles at user request with many design printing possibilities. While use of water based ink for digital printing provides an (Continued)

environment friendly, efficient, and durable method of printing the cover sheets of these products.

8 Claims, 9 Drawing Sheets

(56) References Cited

U.S. PATENT DOCUMENTS

| | | | | |
|---|---|---|---|---|
| 2003/0162454 | A1* | 8/2003 | Kuo | B32B 5/04 442/183 |
| 2005/0153113 | A1* | 7/2005 | Hseih | G09F 3/02 428/201 |
| 2010/0006221 | A1* | 1/2010 | Janke | C08G 18/12 156/322 |
| 2010/0192280 | A1* | 8/2010 | McClard | B41J 2/325 2/161.8 |
| 2016/0159107 | A1* | 6/2016 | Niu | B41M 5/00 442/142 |

FOREIGN PATENT DOCUMENTS

| | | | | |
|---|---|---|---|---|
| WO | WO 02066729 | A1 * | 8/2002 | A63B 41/08 |
| WO | WO 2015041666 | A1 * | 3/2015 | B41M 5/00 |

* cited by examiner

UNDER-GLASS DIGITAL PRINTING METHOD OF MULTILAYER SYNTHETIC LEATHER

TECHNICAL FIELD OF INVENTION

The present invention discloses a novel process of digital printing method of cover sheet of natural or synthetic fabric or leather or other flexible like material and manufacturing of durable, laminated digitally printed cover sheet that is further fixed to the required articles or used on a number of items, including but not exclusively for that of sports, fashion and upholstery.

BACKGROUND OF THE INVENTION

Conventionally, the outer cover sheet of sports articles, uniforms, fashion-ware and other products are printed with silk screens and use of solvent based inks and is on the surface of the material. In many other forms of printed man-made leather, the fabric is printed with roller/off-set, retrograveaur, rotary, or transfer methods, in which a set pattern is repeated in mass printing. The surface-printing with silk-screen is quite costly and inefficient. The available digital methods of surface printing are not durable as they are on the surface and wear out quite quickly. The in-practice methods of printing the man-made leather do not offer the opportunities of customization and have limitations in designing possibilities. Many designs and printing effects are very difficult to produce by these methods. Smaller runs are even more cumbersome and difficult to manage. There is quite a lot of material wastage involved in the conventional methods of printing.

The methods of digital surface printing of sports items are also not that durable as they wear out much more quickly with the usage. The new exemplary products, consistent with the present disclosure, therefore aim to resolve the aforementioned problems and better covering the printing in durable manners. The present disclosure states the novel technique(s) used in the manufacturing process results in improved cover materials, which are durable, lasting and improved graphic and printing possibilities while maintaining the aesthetic value of the products.

SUMMARY

The present disclosure is about novel printing technique (s) to produce a new and improved cover sheet for many products including but not limited to sport's item and goods, sport's wears, sport's equipment footwear, bags, dress & clothes, fashion articles, protective, upholstery items, and furniture covers. The cover sheet for aforesaid articles may be printed using a durable, aesthetic, cost effective, glass sealed digital printing method making customization and offering better design possibilities. It provides opportunities to incorporate reflective materials also, which can make products, glow in the dark also.

In the present invention, a flexible material like fabric either woven or non-woven, thin transparent or opaque film, or paper is first digitally printed by direct digital printing or transfer digital printing or like sublimation method. After printing, a transparent coating or clear film of Polyurethane (PU), Thermoplastic Polyurethane (TPU) or Polyethylene (TPE) or Polyvinylchloride (PVC) or similar substance is applied on the on the printed side directly or with a roller or with the aid of Transfer Paper.

The flexible printed material may be printed with some reflective printing or some reflective tapes may be applied before the application of transparent material like PU, TPU, TPE and PVC. This may make the material glow in the dark.

The article or product produced by such printed technique has a feeling and features of man-made leather but have huge durable customization and printing options making them possible to make numerous items.

Various Foams and linings may be applied on the back of this printed cover sheet. For example, varying thickness of foam, with or without fabric may be applied to make soccer balls, bags, shoes, gloves, fashion items, and upholstery etc.

The novel method of making cover sheet provides an efficient, durable and digital method of glass sealed printing the cover sheets of many products. Horizon of printing becomes much wider, eliminates the needs of screens, and makes smaller runs much easier to manage. The possibilities of use of water-based inks makes it much more environment friendly. Covering it with a clear film of PU, TPU, TPE and PVC or other kind of transparent materials provides durability and wear and water resistant. This clear film is fixed to the cover sheet by applying a layer of transparent and flexible adhesive material like is a Reactive Polyurethane (PUR), Normal Hot-melt Polyurethane or any other adhesive which does not affect the flexibility and transparent properties of the clear film on the printed cover sheet.

BRIEF DESCRIPTION OF THE DRAWINGS

The drawings are accompanied with this specification for the purpose of better disclosure of the present invention. These drawings are enclosed herewith and are part of description. These illustrations made, along with the description help to explain the steps and principles of the present disclosure as under:—

FIG. 4A is the exemplary printing method by transfer paper technique and FIG. 4B is typically exemplary printing method by sublimation technique, consistent with exemplary embodiments of the present disclosure.

DETAILED DESCRIPTION

A new printing technique of articles like sport's items, sport's wears, clothes, bags, cover sheets for vehicles parts and equipment's is disclosed here. Which solves the technical problem of printing quality, customization of design to be printed and durability of printing of aforesaid articles of various shapes, sizes and made up of various materials.

First a flexible cover sheet of woven or non-woven fabric or fabric like materials or thin flexible film, or paper of required flexibility, rigidity and elasticity, is digitally printed by using computerized printing system or machine designed for the purpose. Using digital printing method, the required high quality pictures, drawings, designs, patterns, text or any customized design can be printed at high quality. The flexible cover sheet is digitally printed with either colored or black ink preferably with a water-based ink.

After printing the roll or piece of cover sheet, a transparent coating or clear film of Polyurethane (PU), Thermoplastic Polyurethane (TPU) or Polyethylene (TPE) or Polyvinylchloride (PVC) or other kind of transparent material is applied on the printed side of cover sheet with the help of a roller or with the aid of Transfer Paper or automatic machine.

The transparent or clear film of TPU, PU, TPE or PVC may instead be fixed to cover sheet with the help of transparent adhesive like Reactive Polyurethane (PUR) or Normal Hot-melt Polyurethane or any other adhesive which does not affect the flexibility and transparent properties of the clear film on the printed cover sheet.

The flexible printed cover sheet may also be printed using some reflective printing material or may be some reflective tapes may be also applied before the application of transparent coating or thin clear film of PU, TPU, TPE or PVC coating. This may make the material glow in the dark or reflects the light as the case may be.

This printed and coated cover sheet is cut as per required size and shape of the article's cut-out at which printing is required. Various Foams and linings may be applied on the back of this flexible sealed printed cover sheet. For example, varying thickness of foam, with or without fabric may be applied to make soccer balls, bags, shoes, gloves, and bags etc. This printed and coated cover sheet may be used to manufacture complete flexible articles like soccer balls, bags, uniforms and gloves or patches of this sheet may be used at the flexible products. However, patches or pieces of this printed and coated cover sheet especially may be used for articles of rigid material like cricket bats and helmets etc.

Figure 1:
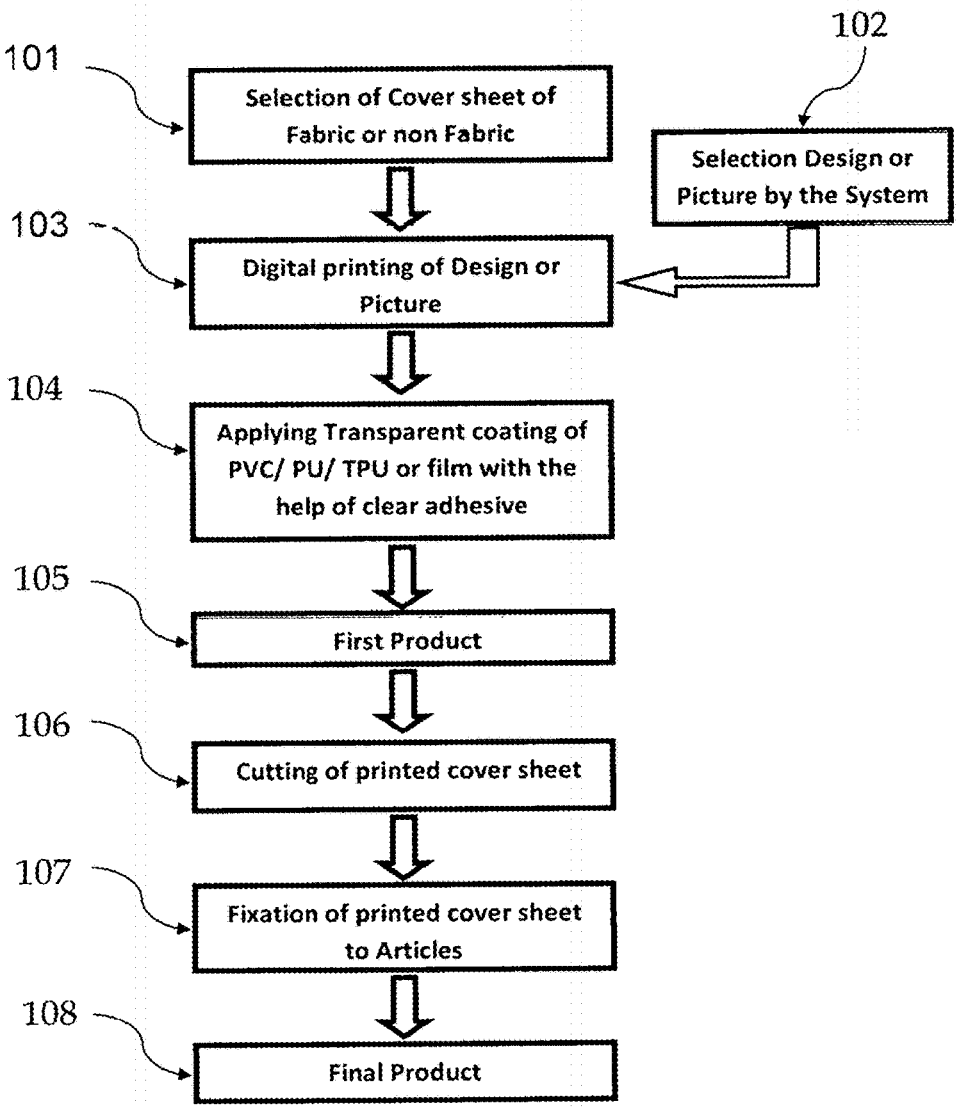
FIG. 1 is representation of flow chart of present invention which shows the steps of printing method and preparation of first product and second product, consistent with exemplary embodiments of the present disclosure.

FIG. 1 is representation of flow chart of present invention which shows the exemplary steps of printing method and preparation of first product and second product, consistent with exemplary embodiments of the present disclosure. The flexible printing of cover sheet of selected material is done in a step by step procedure as indicated in the flow diagram in FIG. 1. The step order can be changed as per requirements. The flexible cover sheet is made up of a selected material as per required features. 101 is selection of material of cover sheet which is made up of at least a layer of woven or non-woven fabric or non-fabric or like material of required density, thickness and transparency. Exemplary step 102 is selected high quality picture(s) or drawing(s), design(s), pattern(s), text or any customized design of high quality. The outer side of the cover sheet of any of above listed material is digitally printed at exemplary step 103 by using a printing machine or computerized control system. Exemplary step 104 shows that a transparent or glass coating or clear film of Polyurethane (PU), Thermoplastic Polyurethane (TPU) or Polyethylene (TPE) or Polyvinylchloride (PVC) or other kind of transparent material is applied or fixed on the printed side of the cover sheet with a roller or with the aid of Transfer Paper or automatic machine. The transparent or clear film of TPU, PU, TPE or PVC may instead be fixed to the printed side of cover sheet by applying a layer of transparent adhesive of material like Reactive Polyurethane (PUR) or Normal Hot-melt Polyurethane or any other adhesive which does not affect the flexibility and transparent properties of the clear film on the printed cover sheet. This step produce a first product 105. At exemplary step 106 the first prepared product 105 is cut to make the cut-outs of the required size and shape of the article at which printing is required. The inner side or non-printed side of the above cut-outs of printed and coated flexible cover sheet is fixed to the surface the articles at exemplary step 107 by applying adhesive or stitching or molding method to produce final product 108.

Figure 2A:
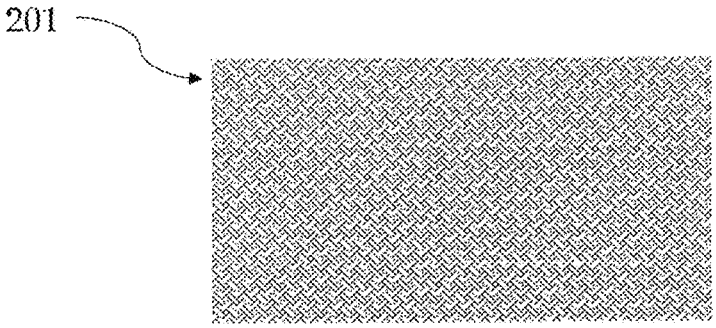
FIGS. 2A-D are different views of the fabric cover sheet. The fabric may be woven, knitted or non-woven, consistent with exemplary embodiments of the present disclosure.
Figure 2B:
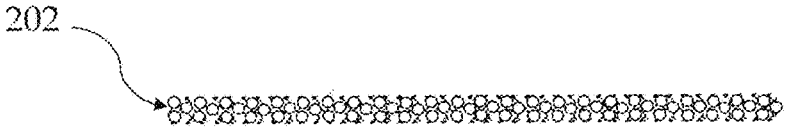
Figure 2C:
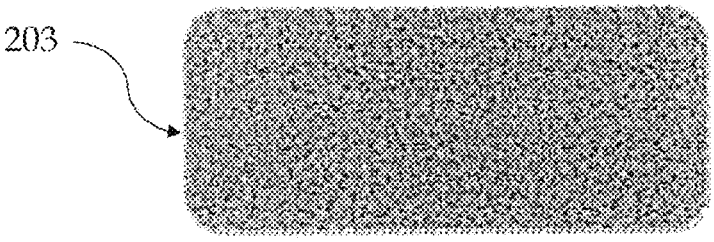
Figure 2D:
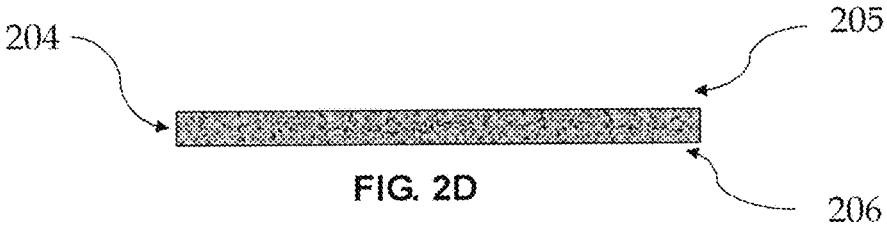

FIGS. 2A-D are different views of the fabric cover sheet. The fabric may be woven, knitted or non-woven or film, consistent with exemplary embodiments of the present disclosure. 201 of FIG. 2A is an exemplary selected flexible cover sheet of woven fabric; and 202 of FIG. 2B is cross-section of same sheet. 203 of FIG. 2C is an exemplary selected flexible cover sheet of non-woven fabric or other flexible material and 204 of FIG. 2D is cross-section of same sheet where 205 is outer surface and 206 is inner surface of exemplary flexible cover sheet.

Figure 3A:
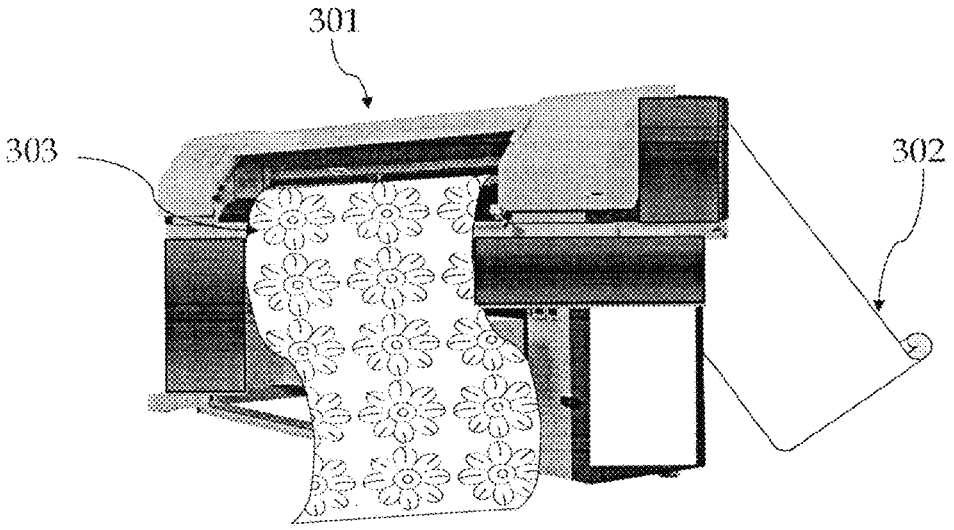
FIGS. 3A-C shows the direct digital printing on the cover sheet of fabric, consistent with exemplary embodiments of the present disclosure.
Figure 3B:
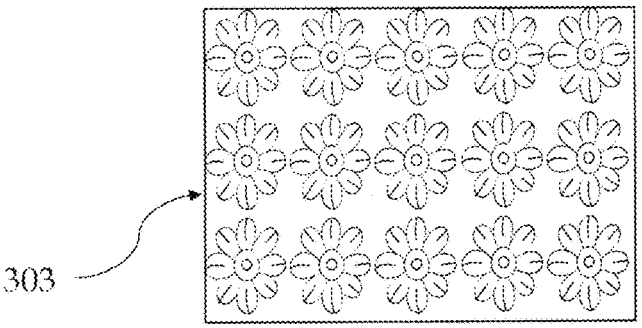
Figure 3C:
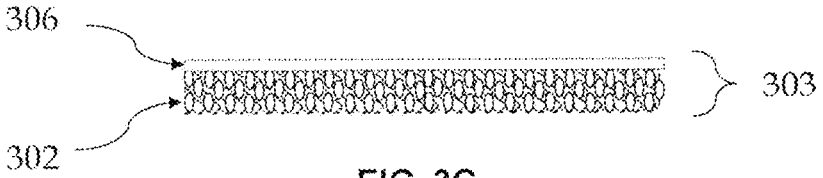

FIGS. 3A-C shows the direct digital printing on the outer surface 205 of the cover sheet of fabric, consistent with exemplary embodiments of the present disclosure. In FIG. 3A is a roll of above selected flexible cover sheet 302 is digitally printed by digital printing system or machine 301. In FIGS. 3A and 3B the digitally printed flexible cover sheet is indicated as 303. 303 may be a printed paper in reverse printing manner for paper transfer technique. In FIG. 3C is cross-section view printed flexible cover sheet where 306 is fine thin layer of printing on 303 of selected flexible cover sheet.

Figure 4A:
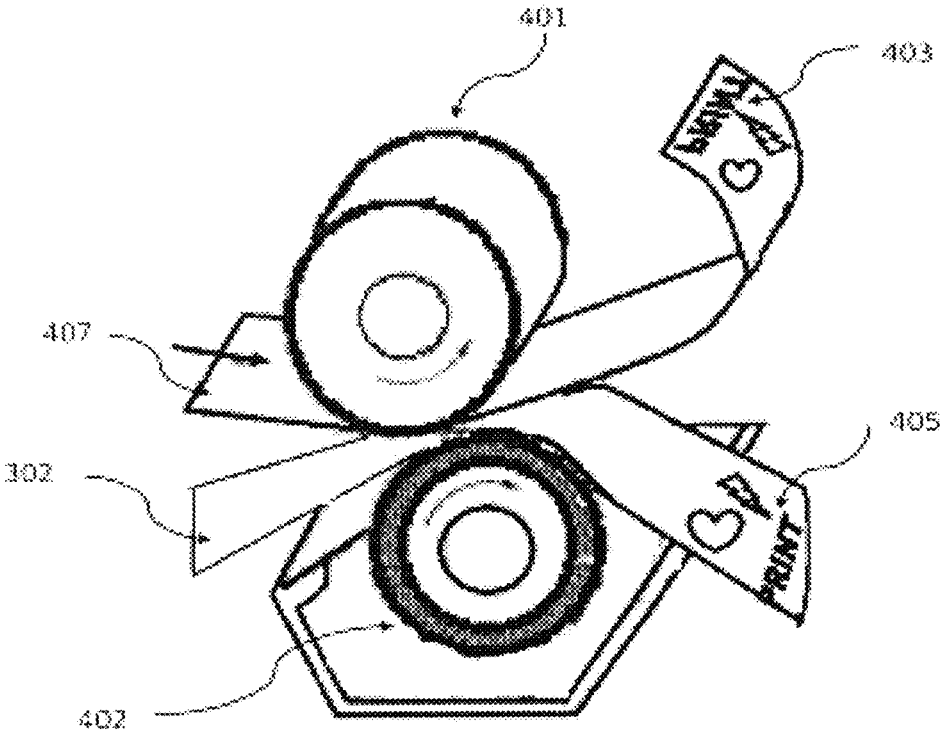
FIGS. 4A and 4B show the printing by transfer paper method, consistent with exemplary embodiments of the present disclosure.
Figure 4B:
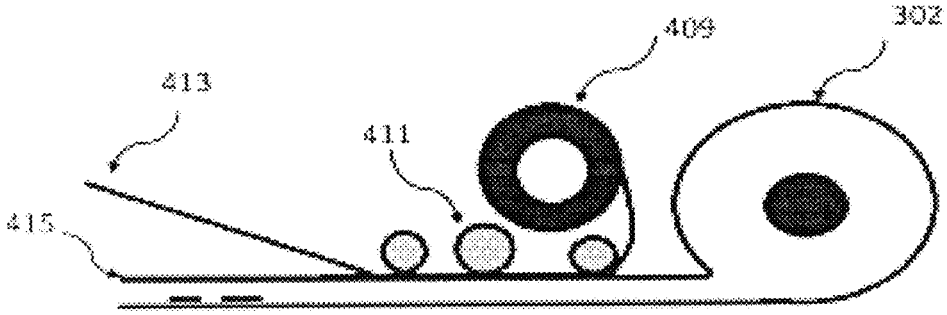

FIGS. 4A-B shows the digital printing by transfer paper method, consistent with exemplary embodiments of the present disclosure. In FIG. 4A the printed paper 407 is an exemplary printed paper printed in reverse manner as shown at 403. 407 is same printed paper in reverse as indicated 303 printed by exemplary digital printing system or machine 301. Whereas 401, 402 are rollers used to press printed paper 407 to print of design of the printed paper at cover sheet 302 by the action of heat and pressure. The printing in actual required order at cover sheet 302 but reverse to printed paper is indicated 405 consistent with exemplary embodiments of the present disclosure.

FIG. 4B is typically exemplary printing method by using sublimation technique, the roll of printed paper is indicated as 409 and 413 is printed paper which is in reverse manner. 413 is same printed paper in reverse as indicated at 303 printed by exemplary digital printing system or machine 301. Whereas 411 is a roller used to press printed paper 413 to print of design of the printed paper at cover sheet 302 by the action of heat and pressure known as sublimation.

The cover sheet 302 is printed in actual required order but reverse to printed paper and is shown as 415 which is achieved by sublimation method consistent with exemplary embodiments of the present disclosure.

Figure 5A:
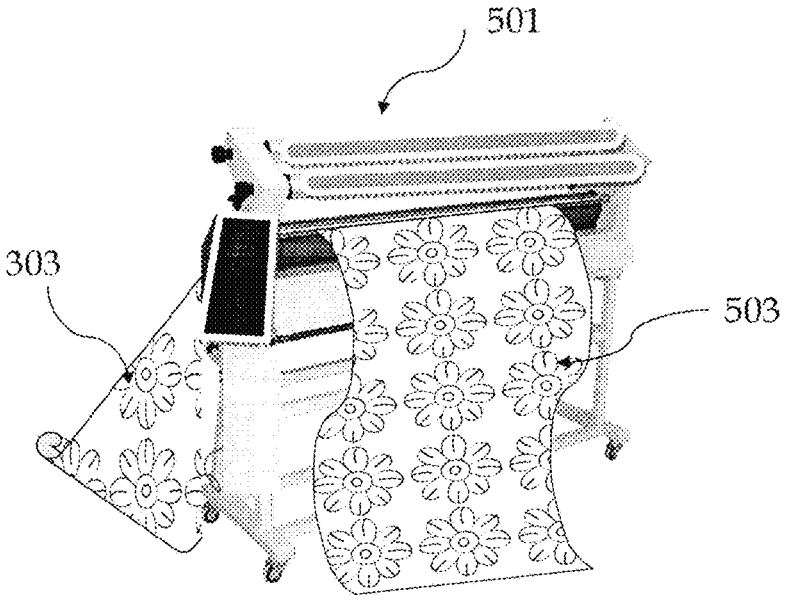
FIGS. 5A-C show the glass or transparent coating of printed cover sheet, consistent with exemplary embodiments of the present disclosure.
Figure 5B:
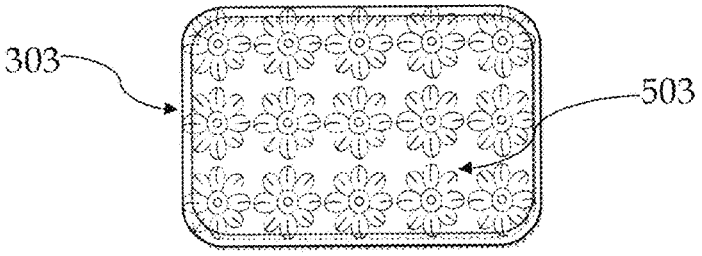
Figure 5C:
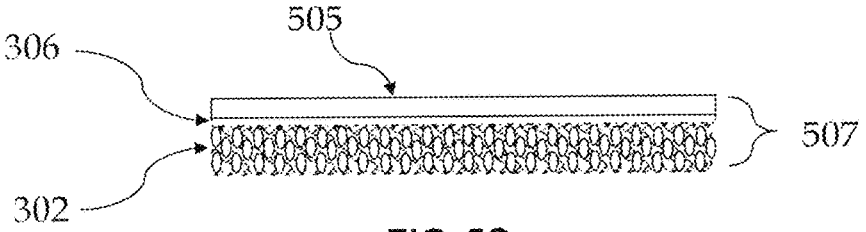

FIGS. 5A-C shows the coating of printed cover sheet, consistent with exemplary embodiments of the present disclosure. In FIG. 5A is a layer of transparent cover of transparent material like PU, TPU, TPE or PVC coating is applied on the printed side of the printed cover sheet 303 using lamination roller or machine 501 designed for the purpose. In FIGS. 4A and 4B the printed and coated flexible cover sheet is indicated as 503. In FIG. 4C is cross-section view printed and coated flexible cover sheet where 505 is a layer of coating of transparent material like TPU, TPE or PVC 306 is fine thin layer of printing on 303 of selected flexible cover sheet. 507 of FIG. 4C is the cross-section view of composite printed and coated flexible cover sheet.

Figure 6A:
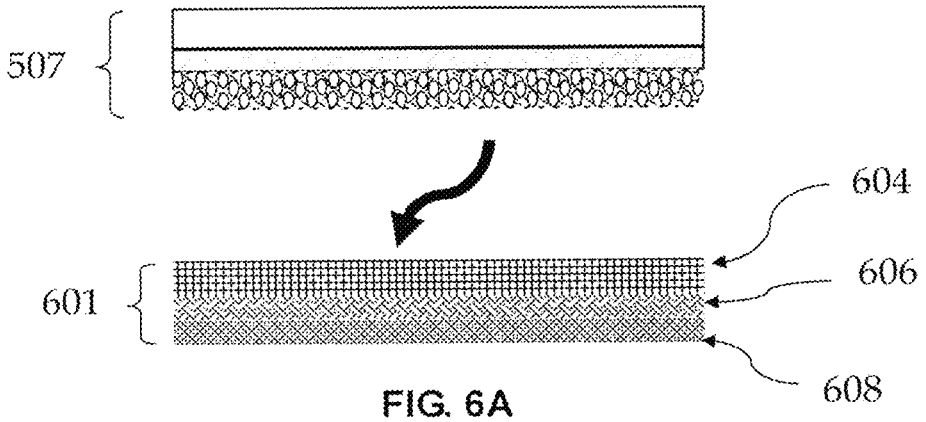
FIGS. 6A and 6B are illustrations of cross sectional views of fixation of printed and coated cover sheet to the outer surface of an article, consistent with exemplary embodiments of the present disclosure.
Figure 6B:
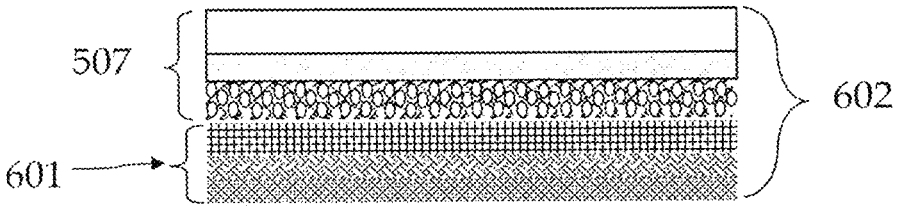

FIGS. 6A and 6B are illustrations of cross sectional views of fixation of the inner surface 206 of the printed and coated cover sheet to the outer surface layer of an article, consistent with exemplary embodiments of the present disclosure. In FIG. 6A is the cross-section view of exemplary composite printed and coated flexible cover sheet 507 is fixed with exemplary surface or a multilayer sheet 601 of article or sport's item where printing is required. This multilayer sheet 601 may consist of at least two sheets or more. However, in this exemplary scenario sheet 601 is composite of three layers 604, 606 and 608 of different materials. 602 of FIG. 6B is the cross-section view of composite printed and coated flexible cover sheet 507 fixed with surface layer or multilayer sheet 601 of the article.

Figure 7A:
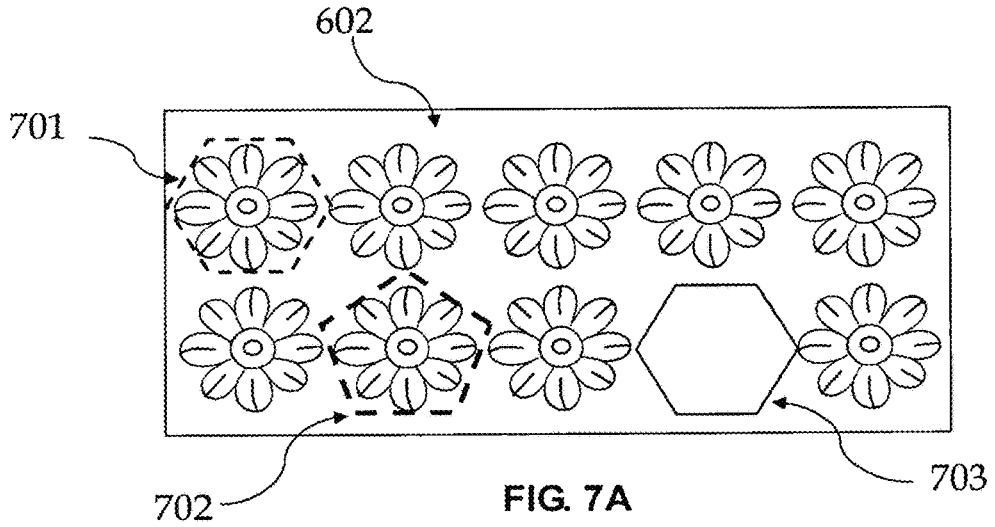
FIGS. 7A and 7B are illustrations of an exemplary scenario for cutting out of cut-outs from printed and coated cover sheet for an article at which printing is required, consistent with exemplary embodiments of the present disclosure.
Figure 7B:
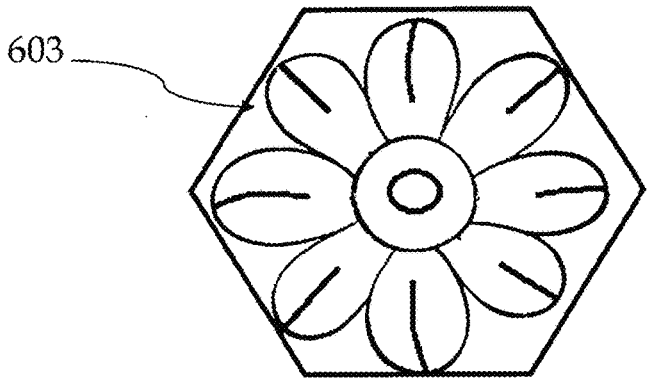

FIGS. 7A and 7B are illustrations of an exemplary scenario for cutting of cut-outs from composite printed and coated cover sheet fixed with outer surface layer of an article, consistent with exemplary embodiments of the present disclosure. 602 of FIG. 7A may represent either composite printed and coated cover sheet of fabric or non-fabric 507 fixed with outer surface layer of composite sheet 601 of an article. As shown FIG. 7A the 701, 702 and 703 are cut-outs of required shape from sheet 602. FIG. 7B is an illustration of an exemplary cut-out 703 that may be cut from sheet 602. In this exemplary scenario, cut-out 703 may represent a cut-out of hexagonal shape for the preparation of a football.

Figure 8:
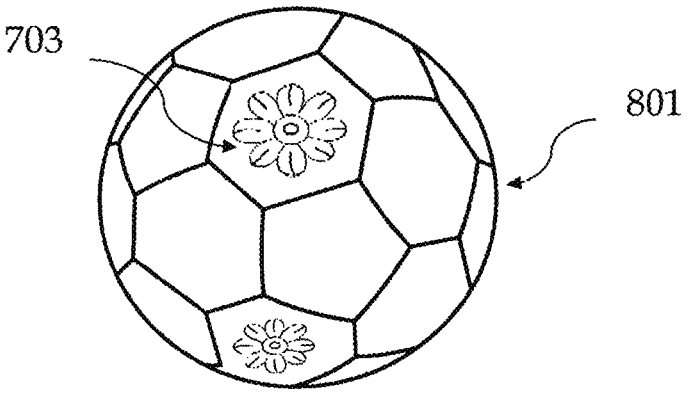
FIG. 8 is illustration of a soccer ball prepared by printed and coated cover sheet, consistent with exemplary embodiments of the present disclosure.

FIG. 8 is illustration of a soccer ball 801 prepared by printed and coated cover sheet 602, consistent with exemplary embodiments of the present disclosure. 703 is a cut-out from the printed and coated cover sheet 602.

Figure 9:
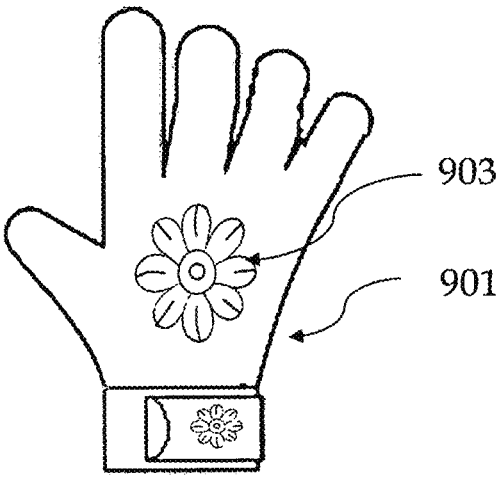
FIG. 9 is illustration of a pair of gloves prepared by printed and coated cover sheet, consistent with exemplary embodiments of the present disclosure.

FIG. 9 is illustration of a pair of gloves 901 prepared by printed and coated cover sheet 602, consistent with exemplary embodiments of the present disclosure. 903 is a cut-out from the printed and coated cover sheet 602.

Figure 10:
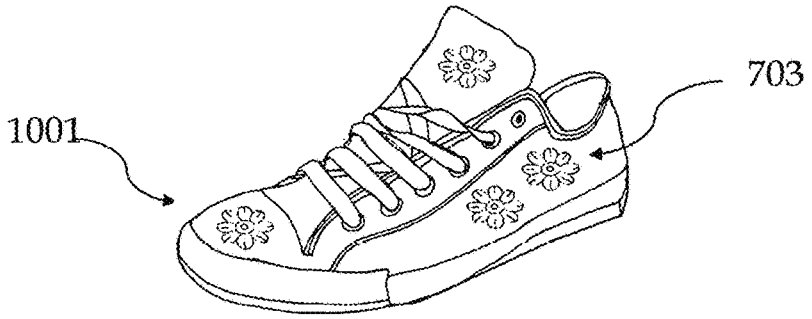
FIG. 10 is illustration of a sport shoe prepared by printed and coated cover sheet, consistent with exemplary embodiments of the present disclosure.

FIG. 10 is illustration of a sport shoe 1001 prepared by printed and coated cover sheet 602, consistent with exemplary embodiments of the present disclosure. 703 is a cut-out from the printed and coated cover sheet 602.

Figure 11:
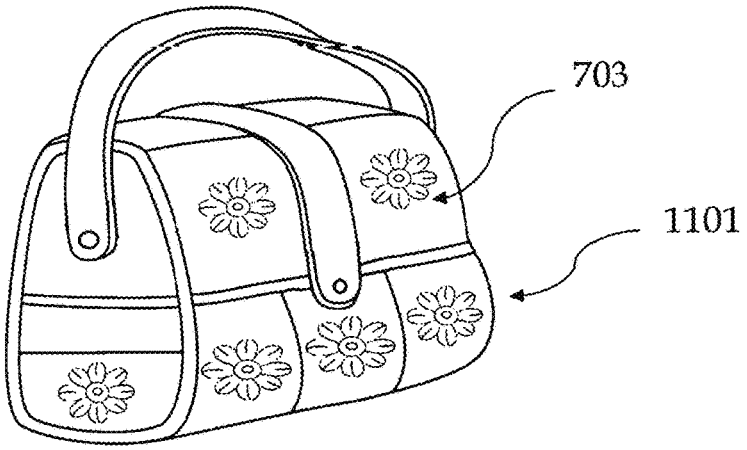
FIG. 11 is illustration of a travel bag prepared by printed and coated cover sheet, consistent with exemplary embodiments of the present disclosure.

FIG. 11 is illustration of a travel bag 1101 prepared by printed and coated cover sheet 602, consistent with exemplary embodiments of the present disclosure. 703 is a cut-out from the printed and coated cover sheet 602.

The present disclosed invention includes three major embodiments. First embodiment is the use of detachable or independent flexible cover sheet of various materials of required characteristics features of flexibility, density, thickness and transparency. Which can be fixed with a range of articles. Second embodiment is the use of digitally printing technique of selected flexible cover sheet. Third embodiment is glass-sealing of this cover sheet by coating a layer of transparent material like PU, TPU, TPE or PVC or fixing a thin film of same material. This film is fixed by applying a layer of Reactive Polyurethane (PUR), Normal Hot-melt Polyurethane or any other adhesive which does not affect the flexibility and transparent properties of the clear film on the printed cover sheet. This transparent layer protect the printing from not only from wear and tear but also from environmental or seasonal condition/affects. This prepared coated cover sheet is further fixed to a variety of articles.

The novel use of digital printing technique used in the manufacturing process of various products which are environment friendly, durable, permanent and high quality graphic and printing possibilities while maintaining the aesthetic value of the products. Digital printing method enables the printing of high definition pictures, images, drawings, designs, patterns, textures or any user customized design on the required article.

This digital printing method on the separate flexible cover sheet and fixation of this to a range of article enabled the customer demands. The article at which this glass coated printed cover sheet may be fixed may be sports items like soccer balls, cricket bats, Rackets, hockey sticks, shin guard, shuttle, golf sticks and bags; sports wears like uniforms, shirts, trousers, helmets, pads, caps, boxing head gears, boxing or Muay Thai gloves and gloves; footwear like shoes; sports equipment's; related vehicles items like seat covers and parts covers; clothes like bed sheet, pillow covers, and bed covers, furniture items like table cover, chair covers, sofa covers; protective, upholstery items and fashion articles etc. A few examples of present disclosure are given here as under:

Example No. 1

A digitally printed woven fabric of around 0.5-0.6 mm thick may be coated/laminated with a clear Thermoplastic Polyurethane (TPU) film of around 0.02-0.2 mm thickness by applying a layer of transparent adhesive, Normal Hot-melt Polyurethane to make material suitable for soccer balls. The non-printed side of this fabric may be further fixed with layer/s of foam and/or fabric, depending upon the quality of ball, to form final product as ball.

Example No. 2

An image of high quality is digitally printed by using transfer paper on non-woven sheet of fabric of around 1.0-1.1 mm thick may be coated with a clear coating of Polyurethane of around 0.02-0.2 mm thickness to make material suitable for balls. The non-printed side of this fabric may be further fixed with layer/s of foam and/or fabric, depending upon the quality of ball, to form final product as ball.

Example No. 3

A high quality image of running CHITAH is digitally printed on a woven sheet of fabric of around 0.5-0.6 mm thick may be coated with a clear Thermoplastic Polyurethane film of around 0.02-0.2 mm thickness by applying a layer of transparent adhesive Normal Hot-melt Polyurethane to make material suitable for shoes. The non-printed side of this fabric may be further fixed with layer/s of foam and/or fabric, depending upon the quality of shoes, to form final product as shoes.

Example No. 4

A high quality picture of a running athlete is digitally printed on non-woven sheet of fabric of around 0.5-0.6 mm thickness. It may be coated with a transparent Polyvinylchloride film of around 0.02-0.2 mm thickness by applying a transparent layer of adhesive to make material suitable for shoes. The non-printed side of this fabric may be further fixed with layer/s of foam and/or fabric, depending upon the quality of shoes, to form final product as shoes.

Example No. 5

A high quality design of digitally printed sheet of woven fabric of around 0.5-0.6 mm thick may be laminated/coated with a clear Thermoplastic Polyurethane film of around 0.02-0.2 mm thickness by applying a transparent layer of adhesive Normal Hot-melt Polyurethane to make material suitable for gloves. The non-printed side of this fabric may be further fixed with layer/s of foam and/or fabric, depending upon the quality of gloves, to form final product as gloves.

Example No. 6

A digitally printed pattern on non-woven sheet of fabric of around 0.5-0.6 mm thick may be coated with a clear Polyurethane film of around 0.02-0.2 mm thickness by applying a transparent layer of adhesive Normal Hot-melt Polyurethane to make material suitable for gloves. The non-printed side of this fabric may be further fixed with layer/s of foam and/or fabric, depending upon the quality of gloves, to form final product as gloves.

Example No. 7

A high quality group picture of cricket team is digitally printed by using sublimation method on woven sheet of fabric of around 0.5-0.6 mm thickness. It may be coated with a transparent Polyurethane film of around 0.02-0.2 mm thickness by applying a transparent layer of adhesive Normal Hot-melt Polyurethane to make material suitable for sports uniforms. The printed and/or coated fabric is used to make dresses and uniforms.

Example No. 8

A high quality picture of green valley is digitally printed by transfer paper method on non-woven sheet of fabric of around 0.7-0.12 mm thickness. It may be coated with a transparent Polyurethane coating of around 0.02-0.06 mm thickness to make material suitable for vehicle's seat covers. The printed and coated fabric is used to make bags and furniture and vehicle's seat covers.

Example No. 9

A high quality pattern and text of a running athlete is digitally printed on woven sheet of fabric of around 0.5-0.6 mm thickness. It may be coated with a transparent Polyurethane film of around 0.02-0.2 mm thickness by applying a transparent layer of adhesive Normal Hot-melt Polyurethane to make material suitable for sports items of rigid materials. The strips of printed and coated fabric is further applied at the handles and parts of the final product like handles of cricket bat etc.

Example No. 10

A high quality picture of new couple is digitally printed by sublimation method on a woven sheet of fabric of around 0.5-0.6 mm thickness. It may be coated with a transparent Polyurethane film of around 0.02-0.2 mm thickness by applying a transparent layer of adhesive to make material suitable for bed sheet and pillow covers. The printed and coated or without coated fabric sheet is used to make bed sheet and pillow covers as final product.

What is claimed:

1. A method of printing on a cover sheet for a soccer ball, the method comprising the steps of:

providing a cover sheet of a flexible substrate composite comprising a web, woven fabric, non-woven fabric, and paper, wherein the paper has a specific density, thickness, elasticity, flexibility, transparency and strength, and wherein the cover sheet has an outer side and an inner side, one of the woven fabric and non-woven fabric forming the outer side;

selecting a design pattern or a picture to be printed at the soccer ball;

digitally printing the outer side of the cover sheet using sublimation printing method, to form a printed cover sheet;

applying a transparent coating to the printed side of the printed cover sheet wherein the transparent coating is one of a layer of transparent material or a thin film of transparent material fixed with transparent adhesive material to the printed side of the printed cover sheet;

cutting out of cut-outs from the printed and coated cover sheet, of required size and shape;

fixing the inner side of the printed and coated cover sheet with an outer surface layer of bladder of the soccer ball at which printing is required by using one method among applying a layer of adhesive, applying molding method and stitching between the inner side of the printed and coated cover sheet and to the outer surface layer of the soccer ball to form final product.

2. The method of printing on the cover sheet of claim 1 wherein the outer side of the cover sheet is made of fabric and inner side is one of monolayer or multilayer composite sheet made up of material at least one of foamy substance, fabric, rubber, leather and bi-cast leather wherein the multilayer composite sheet is made up of the said materials in combination.

3. The method of printing on the cover sheet of claim 1 wherein the printing ink is water based.

4. The method of printing on the cover sheet of claim 1 wherein the printing ink is oil or solvent based.

5. The method of printing on the cover sheet of claim 1 where the soccer ball completely or a part of the soccer ball is made by the printed and coated cover sheet.

6. The cover sheet prepared by the printing method of claim 1.

7. The method of printing on the cover sheet of claim 1 wherein the printing ink has at least one of reflective and glittering substance on the cover sheet to form a printed cover sheet.

8. The method of printing on the cover sheet of claim 1 wherein the transparent coating is a layer or a thin film of transparent material comprising one of polyurethane (PU), thermoplastic polyurethane (TPU), polyethylene (TPE) and polyvinylchloride (PVC) fixed on the printed side of the printed cover sheet by applying a layer of transparent adhesive material comprising one of reactive polyurethane (PUR) and normal Hot-melt polyurethane.

* * * * *